US009284076B2

(12) United States Patent
Monti

(10) Patent No.: US 9,284,076 B2
(45) Date of Patent: Mar. 15, 2016

(54) APPARATUS FOR COLLECTING A TUBULAR BOX IN A FLATTENED CONFIGURATION FROM A STORE, FOR OPENING-OUT THE TUBULAR BOX AND FOR TRANSFERRING THE TUBULAR BOX TOWARDS A RECEIVING STATION OF THE TUBULAR BOX

(71) Applicant: Marchesini Group S.p.A, Pianoro (Bologna) (IT)

(72) Inventor: Giuseppe Monti, Pianoro (IT)

(73) Assignee: MARCHESINI GROUP S.p.A., Pianoro (Bologna) (IT)

( * ) Notice: Subject to any disclaimer, the term of this patent is extended or adjusted under 35 U.S.C. 154(b) by 569 days.

(21) Appl. No.: 13/728,612

(22) Filed: Dec. 27, 2012

(65) Prior Publication Data

US 2013/0186043 A1 Jul. 25, 2013

(30) Foreign Application Priority Data

Jan. 19, 2012 (IT) ..... BO2012A0021

(51) Int. Cl.

| | |
|---|---|
| ***B65B 5/00*** | (2006.01) |
| ***B31B 5/80*** | (2006.01) |
| ***B65B 43/28*** | (2006.01) |

(Continued)

(52) U.S. Cl.

CPC ... *B65B 5/00* (2013.01); *B31B 5/80* (2013.01); *B65B 43/08* (2013.01); *B65B 43/185* (2013.01); *B65B 43/285* (2013.01); *B65B 43/305* (2013.01); *B31B 2201/027* (2013.01); *B31B 2201/289* (2013.01); *B31B 2217/082* (2013.01);

(Continued)

(58) Field of Classification Search

CPC ..... B31B 3/02; B31B 5/00; B31B 5/02; B31B 5/76; B31B 5/78; B31B 5/80; B31B 17/00; B31B 17/74

USPC ..... 53/252, 131.2; 493/309, 310, 311, 53, 493/320, 318, 315

See application file for complete search history.

(56) References Cited

U.S. PATENT DOCUMENTS 3,293,998 A * 12/1966 Farnow ..... 493/310
4,531,931 A * 7/1985 Dietrich ..... B31B 1/06 493/309

(Continued)

OTHER PUBLICATIONS

European Patent Office Search Report for corresponding application EP12199454, completed May 23, 2013, 2 pages.

*Primary Examiner* — Andrew M Tecco
*Assistant Examiner* — Chelsea Stinson
(74) *Attorney, Agent, or Firm* — R. Neil Sudol; Henry D. Coleman

(57) ABSTRACT

An apparatus for collecting a flattened tubular box, for opening-out and transferring the tubular box towards a receiving station has a first member hinged to a frame, bearing first aspirating means. Second, third, and fourth hinged members and the frame forming a four-bar linkage. A fifth member, hinged to the fourth member, bears second aspirating means. An abutting member is arranged between the first member and the receiving station inferiorly of the tubular box. The apparatus is being designed such that when the tubular box is in the folding position, a second wall of the box can be intercepted by the second aspirating means and folded progressively with respect to the first wall, the first aspirating means disengage the first wall, and the box moved by the second aspirating means up to rest on the abutting member with a consequent complete opening-out of the tubular box.

3 Claims, 8 Drawing Sheets

(51) Int. Cl.

| | |
|---|---|
| ***B65B 43/08*** | (2006.01) |
| ***B65B 43/18*** | (2006.01) |
| ***B65B 43/30*** | (2006.01) |
| *B65B 35/20* | (2006.01) |
| *B65B 35/40* | (2006.01) |

(52) U.S. Cl.
CPC ..... *B65B 35/20* (2013.01); *B65B 35/205* (2013.01); *B65B 35/40* (2013.01); *B65B 35/405* (2013.01)

(56) References Cited

U.S. PATENT DOCUMENTS

| | | | | | |
|---|---|---|---|---|---|
| 4,629,446 | A * | 12/1986 | Focke | 493/317 | |
| 5,102,385 | A * | 4/1992 | Calvert | B65B 43/305 492/315 | |
| 5,120,293 | A * | 6/1992 | Franklin | B31B 1/80 493/125 | |
| 5,176,612 | A * | 1/1993 | Calvert | B31B 1/06 493/315 | |
| 5,234,314 | A * | 8/1993 | Ganz | B65H 3/0808 414/797 | |
| 5,298,008 | A * | 3/1994 | Decker et al. | 493/313 | |
| 6,699,165 | B1 * | 3/2004 | Krieger et al. | 493/122 | |
| 7,976,449 | B2 * | 7/2011 | Klein | 493/318 | |
| 8,020,361 | B2 * | 9/2011 | Kobierzycki et al. | 53/564 | |
| 8,277,367 | B2 * | 10/2012 | Jannin et al. | 493/374 | |
| 2003/0040413 | A1 * | 2/2003 | Malecki et al. | 493/309 | |
| 2007/0072756 | A1 | 3/2007 | Monti | | |
| 2008/0300123 | A1 * | 12/2008 | Bonnain | 493/310 | |
| 2009/0264269 | A1 | 10/2009 | Monti | | |
| 2011/0177927 | A1 | 7/2011 | Monti | | |

* cited by examiner

APPARATUS FOR COLLECTING A TUBULAR BOX IN A FLATTENED CONFIGURATION FROM A STORE, FOR OPENING-OUT THE TUBULAR BOX AND FOR TRANSFERRING THE TUBULAR BOX TOWARDS A RECEIVING STATION OF THE TUBULAR BOX

FIELD OF THE INVENTION

The present invention relates to the technical sector concerning the packing of articles, for example portions of celled strips containing tablets, internally of tubular boxes. In particular, the invention relates to an apparatus for collecting a tubular box in a flattened configuration from a store, for opening-out the tubular box towards a receiving station of the tubular box, where the tubular box can be filled with articles or a further handling/transfer of the tubular box.

DESCRIPTION OF THE PRIOR ART

Tubular boxes are obtainable from tubular blanks that are initially in a flattened configuration such as to enable optimal storage thereof. Thereafter, the boxes are opened-out for receiving the articles internally thereof and are then closed. A tubular box in a flattened configuration comprises a first sheet and a second sheet which are in contact with one another or in strict vicinity to one another. The first sheet is connected to the second sheet at two common and opposite ends. The first sheet is provided with a first wall and a second wall which are separated from one another by a first fold line. Likewise, the second sheet is provided with a third wall and a fourth wall which are separated from one another by a second fold line. Closing flaps of the tubular box are also provided.

As is known, the opening-out of the box consists in distancing the first sheet and the second sheet from one another such as to define a parallelepiped having two opposite openings and formed by the first wall, the second wall, the third wall and the fourth wall. The two opposite openings will then be closed by folding the closing flaps.

SUMMARY OF THE INVENTION

The aim of the present invention consists in designing an apparatus for collecting a tubular box in a flattened configuration from a store, in order to open it out and transfer it into a receiving station of the tubular box.

The above aim is obtained with an apparatus for collecting a tubular box in a flattened configuration from a store, for opening the tubular box out and for transferring the tubular box towards a receiving station of the tubular box, the tubular box in the flattened configuration comprising a first sheet and a second sheet which are in contact which are in contact with one another or in strict vicinity to one another, the first sheet being connected to the second sheet at two common and opposite ends, the first sheet being provided with a first wall and a second wall which are separated from one another by a first fold line. The tubular box in the flattened configuration is collectable from the outlet of a store where it is inclined by a first angle with respect to a horizontal plane and exhibits the first sheet facing towards the outside in such a way that the first wall is at a greater height than the second wall. The apparatus is positionable in the vicinity of a receiving station of the tubular box and the outlet of the store. The apparatus comprises a frame, a first member operating below the outlet of the store, which first member is hinged to the frame at a first hinge axis, and bearing first aspirating means, can rotate such that the first aspirating means intercept the first wall of the first sheet so as to collect the tubular box from the outlet of the store and to bring it into a folding position which is set at a lower height with respect to the outlet of the store. A second member is hinged to the frame at a second hinge axis, with a third member is hinged to the frame at a third hinge axis. A fourth member is hinged to the second member at a fourth hinge axis and to the third member at a fifth hinge axis. The second member, the third member, the fourth member and the frame identify a four-bar linkage. A fifth member is hinged to the fourth member at a sixth hinge axis and bears second aspirating means. An abutting member for encountering the first wall of the first sheet of the tubular box, is arranged between the first member and the receiving station and inferiorly of the tubular box when the tubular box is in the folding position. The apparatus is designed such that when the tubular box is in the folding position, the second wall of the first sheet can be intercepted by the second aspirating means and the first wall and the second wall can be moved in such a way that the second wall rotates with respect to the first wall about a hinge axis that coincides with the first fold line. The first aspirating means can disengage the first wall and the tubular box can be moved by the second aspirating means up to rest on the abutting member with a consequent complete opening-out of the tubular box. The proposed apparatus can be functionally interposed between a store and a station for receiving the boxes which have been opened out. The invention is advantageously particularly compact and can guarantee high standards of productivity. The tubular box is transferred towards the receiving station and is at the same time opened-out.

BRIEF DESCRIPTION OF THE DRAWINGS

Specific embodiments of the invention will be described in the following of the present description, according to what is set out in the claims and with the aid of the accompanying tables of drawings, in which:

DESCRIPTION OF PREFERRED EMBODIMENTS

With reference to the accompanying tables of drawings, (1) denotes in its entirety an apparatus for collecting a tubular box (2) in a flattened configuration from a store, for opening-out the tubular box (2) and for the transfer of the tubular box (2) towards a receiving station of the tubular box (2).

Figure 7:
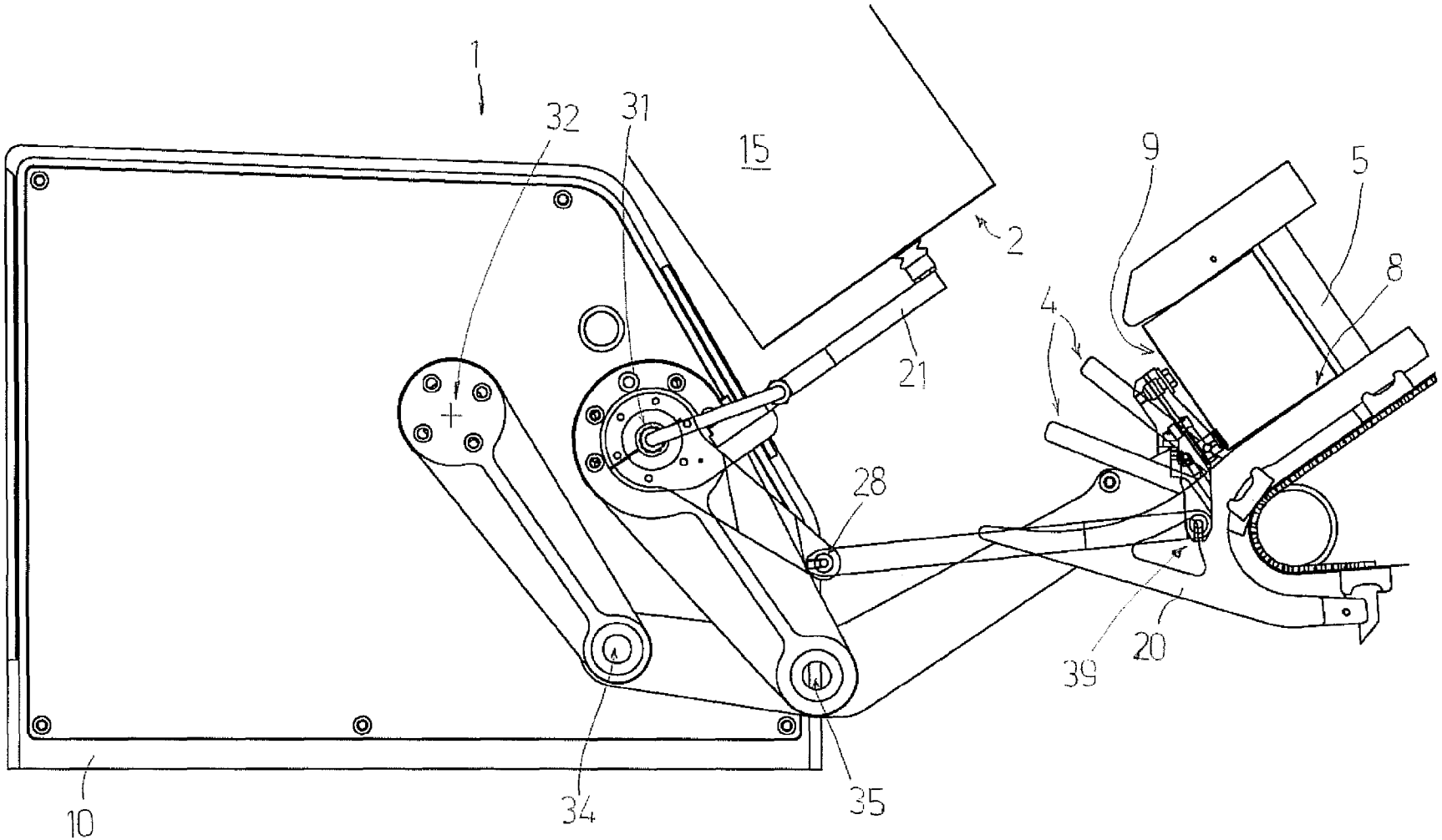
Figure 7A:
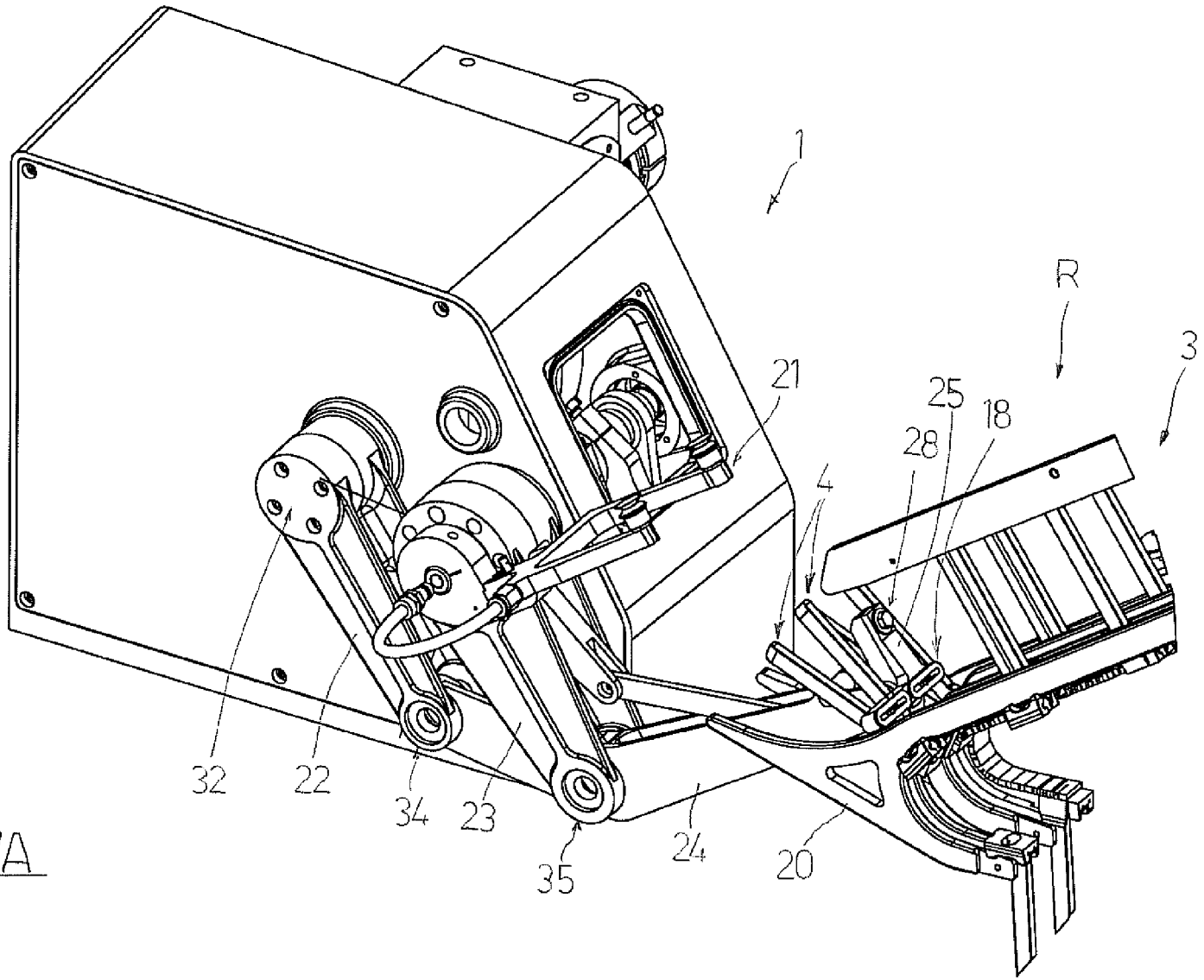
FIG. 7A is a perspective view of the apparatus during an operating step corresponding to the step illustrated in FIG. 7 and wherein for the sake of clarity the store has not been illustrated; nor the opened-out tubular box.

In the illustrated example of the drawings, the receiving station (R) is a conveyor (3) (of known type) having two chains which bear the elongate drawing elements (4) of an opened-out tubular box (2), see for example FIG. 7A. These elongate drawing elements (4) and elongate abutting elements (5) move the tubular box (2) and keep it in the opened-out configuration, such that it maintains the shape of a parallelepiped having two opposite openings, with the aim of the following introduction internally thereof of articles (not illustrated), for example packs of portions of celled strip containing tablets.

Figure 3:
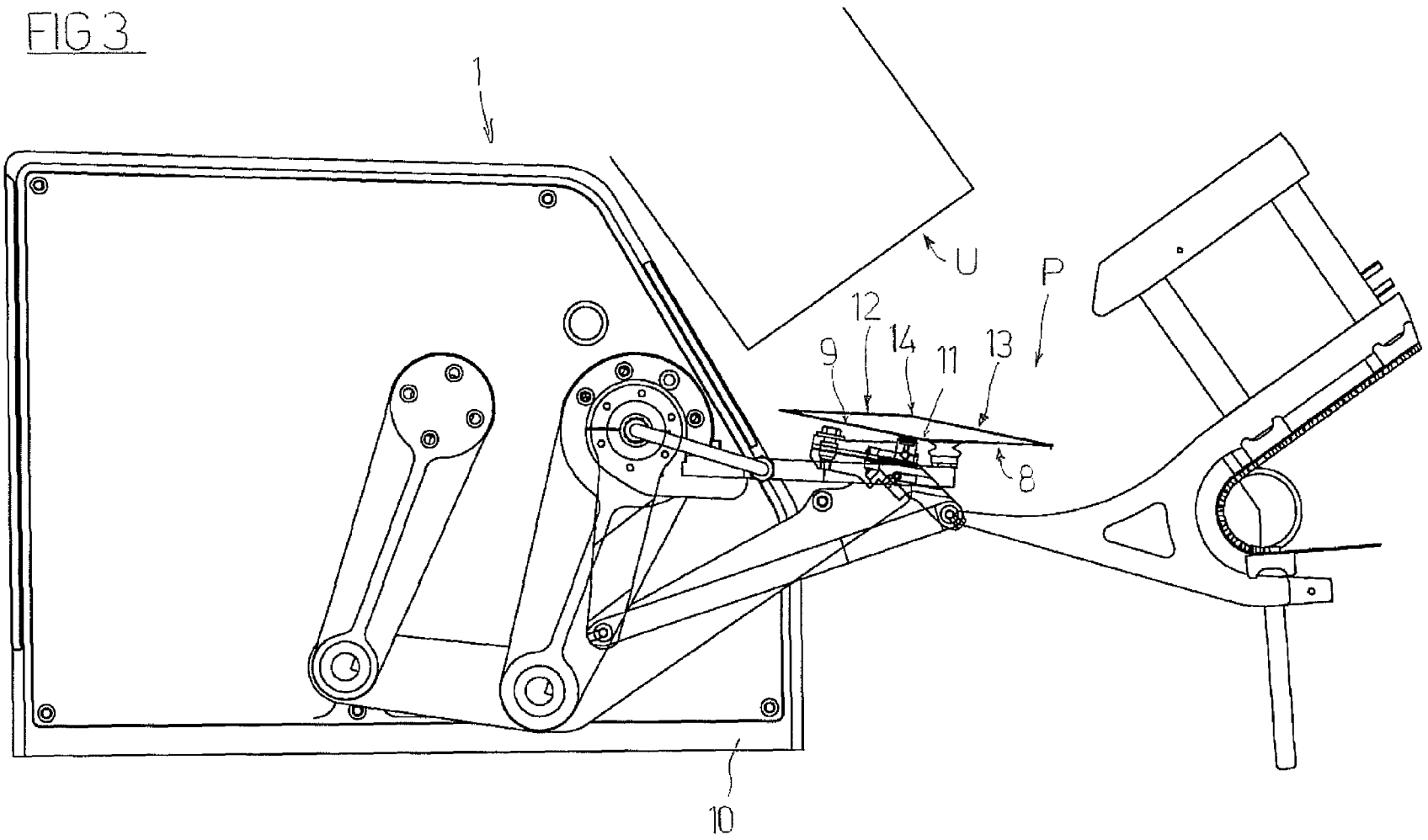
Figure 4:
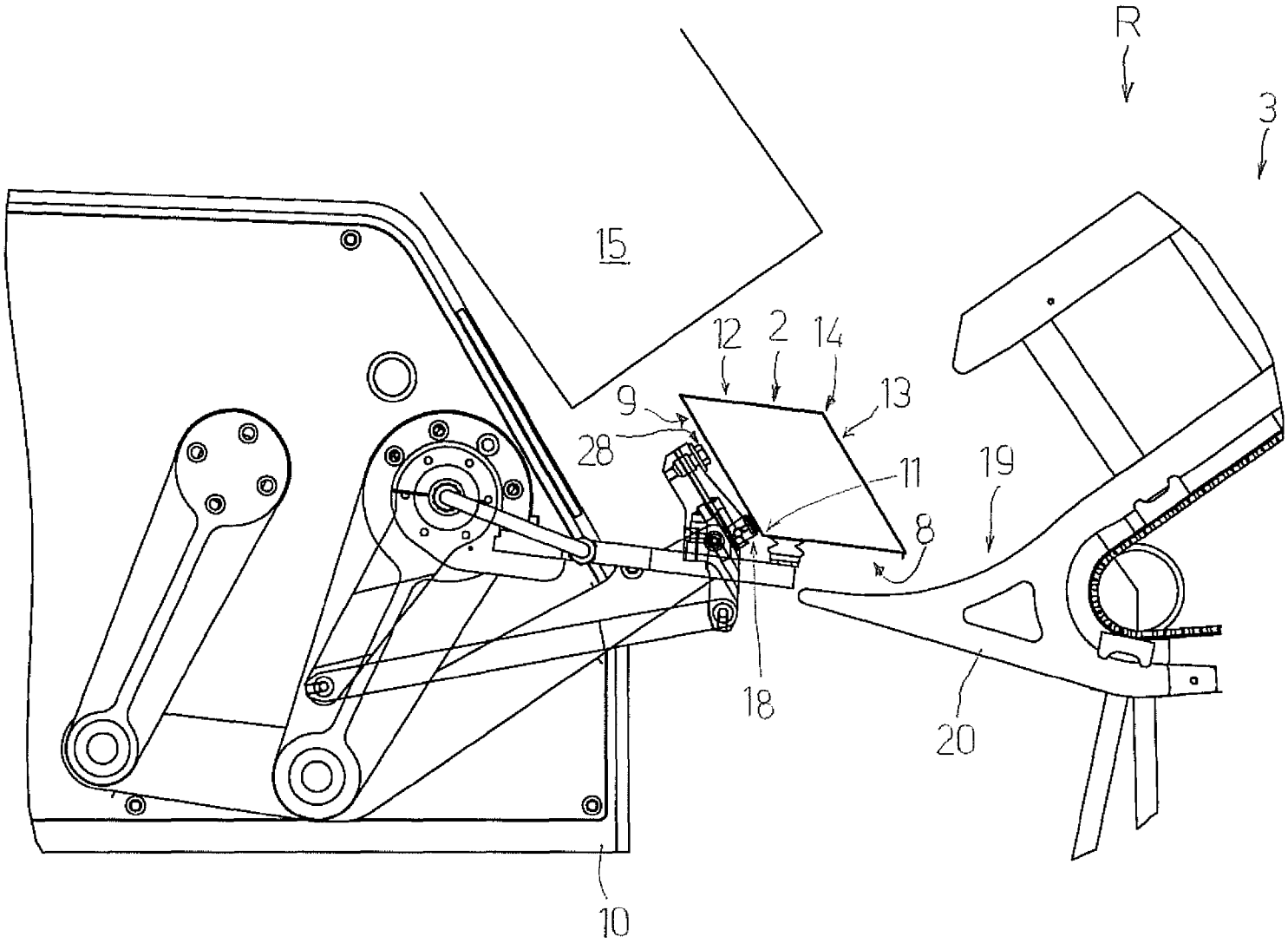

As already mentioned, a tubular box (2) in the flattened configuration comprises a first sheet (6) and a second sheet (7) which are in contact with one another or are in close contact with one another; the first sheet (6) is connected to the second sheet (7) at two common and opposite ends thereof. The first sheet (6) is provided with a first wall (8) and a second wall (9) which are separated from one another by a first fold line (11); likewise, the second sheet (7) is provided with a third wall (12) and a fourth wall (13) which are separated from one another by a second fold line (14) (FIGS. 3, 4). The tubular box (2) further comprises closing flaps (not visible in the figures) of the tubular box (2).

The tubular box (2) in the flattened configuration is collectable from the outlet (U) of a store (15) where it is inclined by a first angle (a) with respect to a horizontal plane (O) (FIG. 1) and exhibits the first sheet (6) facing towards the outside such that the first wall (8) is at a greater height than the second wall (9).

The apparatus (1) is positionable in a vicinity of a receiving station (R) of the tubular box (2) and the outlet (U) of the store (15).

The apparatus (1) comprises: a frame (10), a first member (21) operating below the outlet (U) of the store (15), which first member (21) is hinged to the frame (10) at a first hinge axis (31), bears first aspirating means (17) and can rotate such that the first aspirating means (17) intercept the first wall (8) of the first sheet (6) such as to collect the tubular box (2) from the outlet (U) of the store (15) and to bring it into a folding position (P) (FIG. 2) which is set at a lower height with respect to the outlet (U) of the store (15); a second member (22) which is hinged to the frame (10) at a second hinge axis (32); a third member (23) which is hinged to the frame (10) at a third hinge axis; a fourth member (24) which is hinged to the second member (22) at a fourth hinge axis (34) and which is hinged to the third member (23) at a fifth hinge axis (35); the second member (22), the third member (23), the fourth member (24) and the frame (10) identifying a four-bar linkage; a fifth member (25) which is hinged to the fourth member (24) at a sixth hinge axis (36) and which bears second aspirating means (18); an abutting member (20) for encountering the first wall (8) of the first sheet (6) of the tubular box (2), which abutting member (20) is arranged between the first member (21) and the receiving station (R) and is arranged inferiorly of the tubular box (2) when the tubular box (2) is in the folding position (P).

Figure 5:
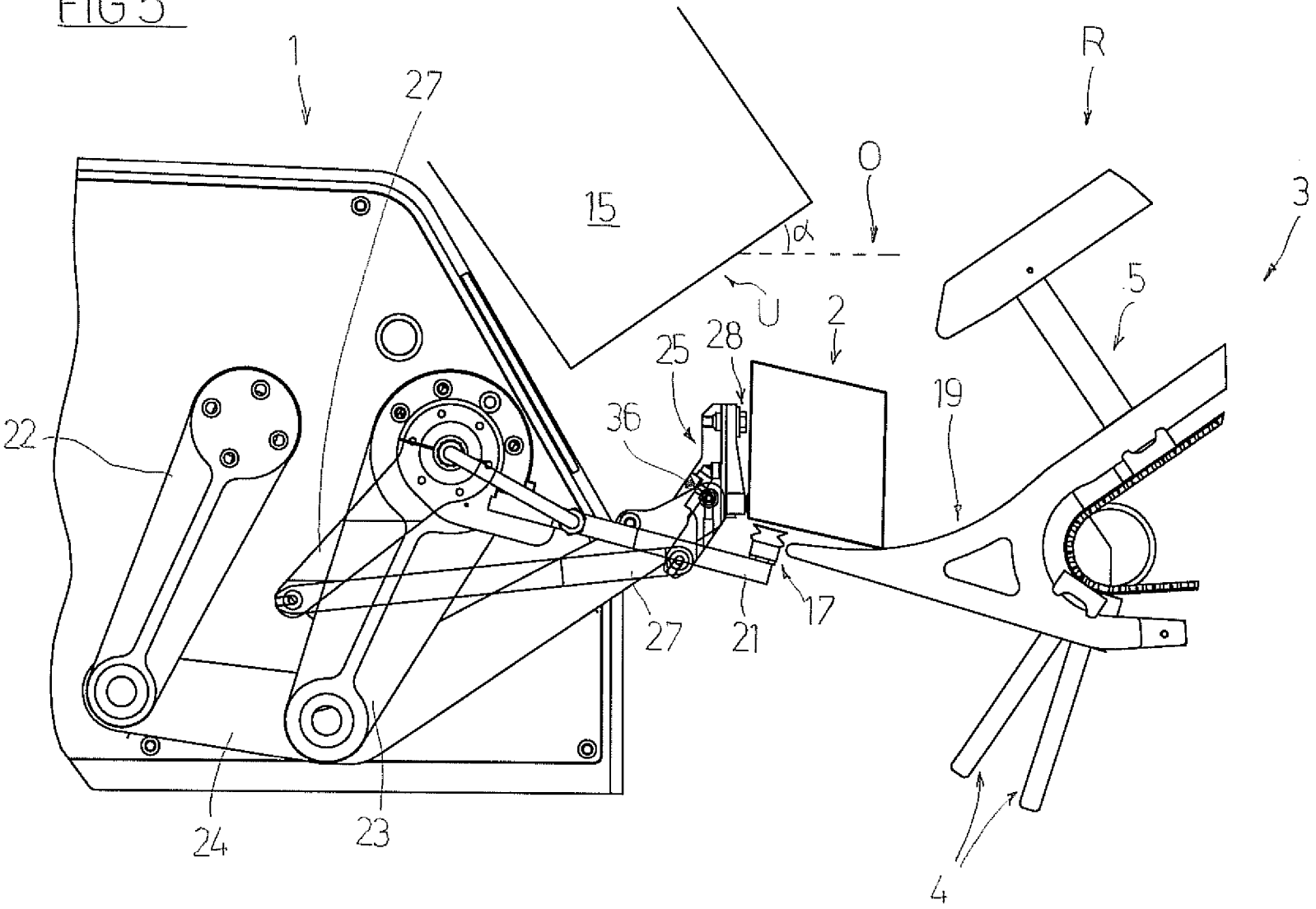
Figure 6:
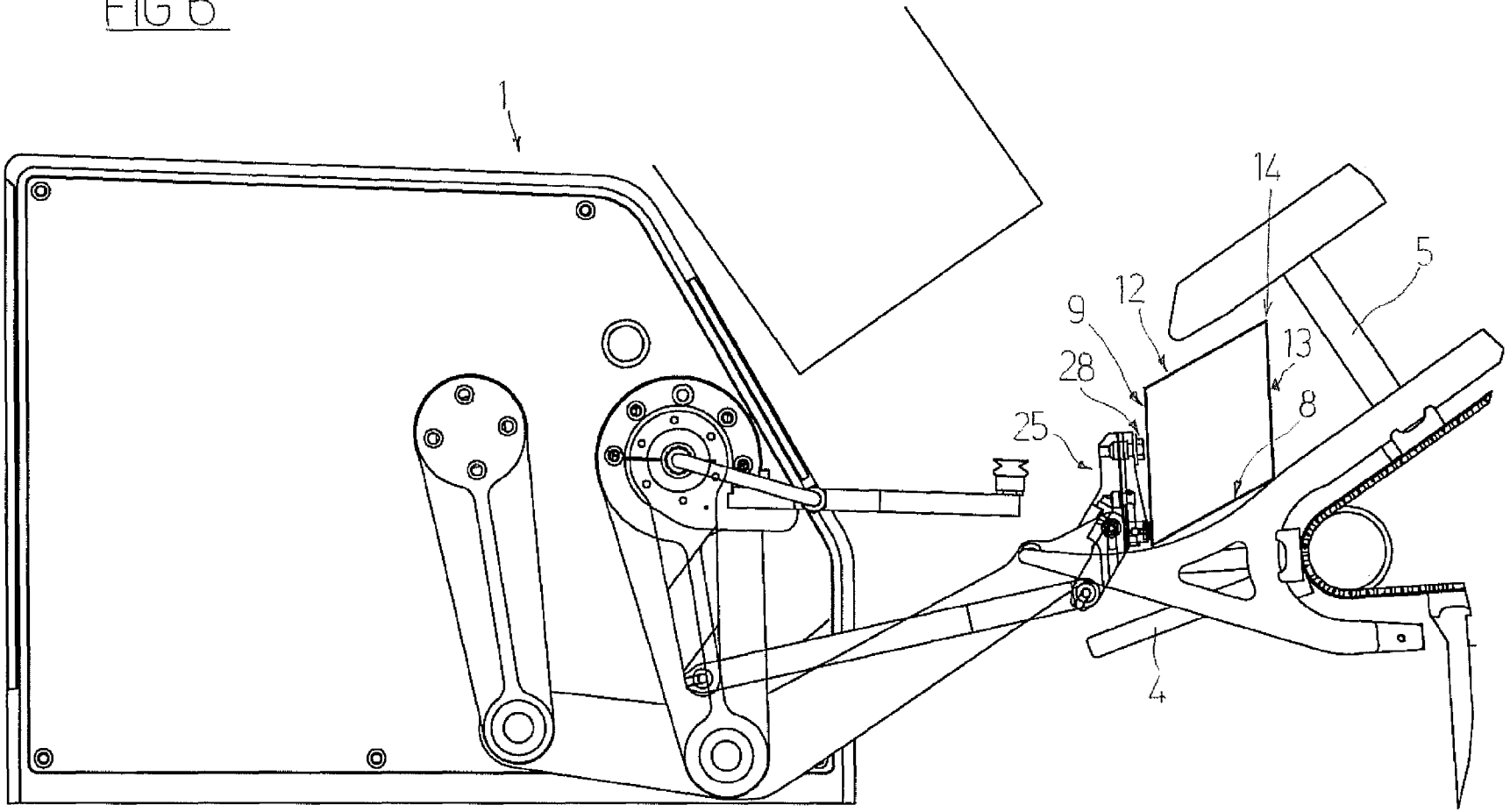

The apparatus is designed such that when the tubular box (2) is in the folding position (P) (FIGS. 2, 3, 4): the second wall (9) of the first sheet (6) can be intercepted by the second aspirating means (18) and the first wall (8) and the second wall (9) can be moved in such a way that the second wall (9) rotates with respect to the first wall (9) about a hinge axis that coincides with the first fold line (11) (FIGS. 3, 4); the first aspirating means (17) can disengage the first wall (8) (FIG. 5) and the tubular box (2) can be moved by the second aspirating means (18) up to coming to rest on the abutting member (20) with a consequent complete opening-out of the tubular box (2) (FIGS. 5, 6, 7).

The first aspirating means (17) can comprise an aspirating source (not illustrated) and suckers connected to the aspirating source and borne by the first member (21).

The second aspirating means (18) can comprise an aspirating source (not illustrated) and suckers connected to the aspirating source and borne by the fifth member (25).

In the illustrated example the abutting member (20) is fixed to the conveyor frame (3); the abutting surface (19) which abuts the first wall (8) of the tubular box (2) and which supportingly receives the tubular box (2) is conformed such as to guide the tubular box (2) during the advancing thereof along the abutting surface (19), up to the opening-out of the tubular box (2).

The first hinge axis (31), the second hinge axis (32), the third hinge axis, the fourth hinge axis (34), the fifth hinge axis (35) and the sixth hinge axis (36) are preferably parallel to one another and horizontal.

The apparatus (1) can comprise a sixth member (26) which is hinged to the frame (10) at a seventh hinge axis, and a seventh member (27) which is hinged to the sixth member (26) at an eighth hinge axis (38) and which is hinged to the fifth member (25) at a ninth hinge axis (39), the sixth member (26) and the seventh member (27) being designed to move the fifth member (25).

The seventh hinge axis, the eighth hinge axis (38) and the ninth hinge axis (39) can also be parallel to the remaining hinge axes.

The fifth member (25) can be hinged to the fourth member (24) at a central portion of the fifth member (25); further, the fifth member (25) can bear the second aspirating means (18) at the relative central portion. The fifth member (25) can be hinged to the seventh member (27) at a first end; further, the fifth member (25) can form an abutment (28) which can be an aid in cooperating with the second aspirating means (18) with the aim of bending the second wall (9) of the first sheet (6) of the tubular box (2) (see the accompanying figures). In the illustrated example this abutment (28) does not intervene, however it could be useful for some box formats of larger dimensions (which have not been illustrated).

The distance between the ninth hinge axis (39) and the sixth hinge axis (36) represents the activating "lever" of rotating activation of the fifth member (25). In the example illustrated in the accompanying figures, the first hinge axis (31) coincides with the third hinge axis and with the seventh hinge axis; this simplifies the design of the means which have to move the four-bar linkage, the fifth member (25) and the first member (21) as the means act only on the first hinge axis (31).

The four-bar linkage is preferably a hinged parallelogram.

Figure 1:
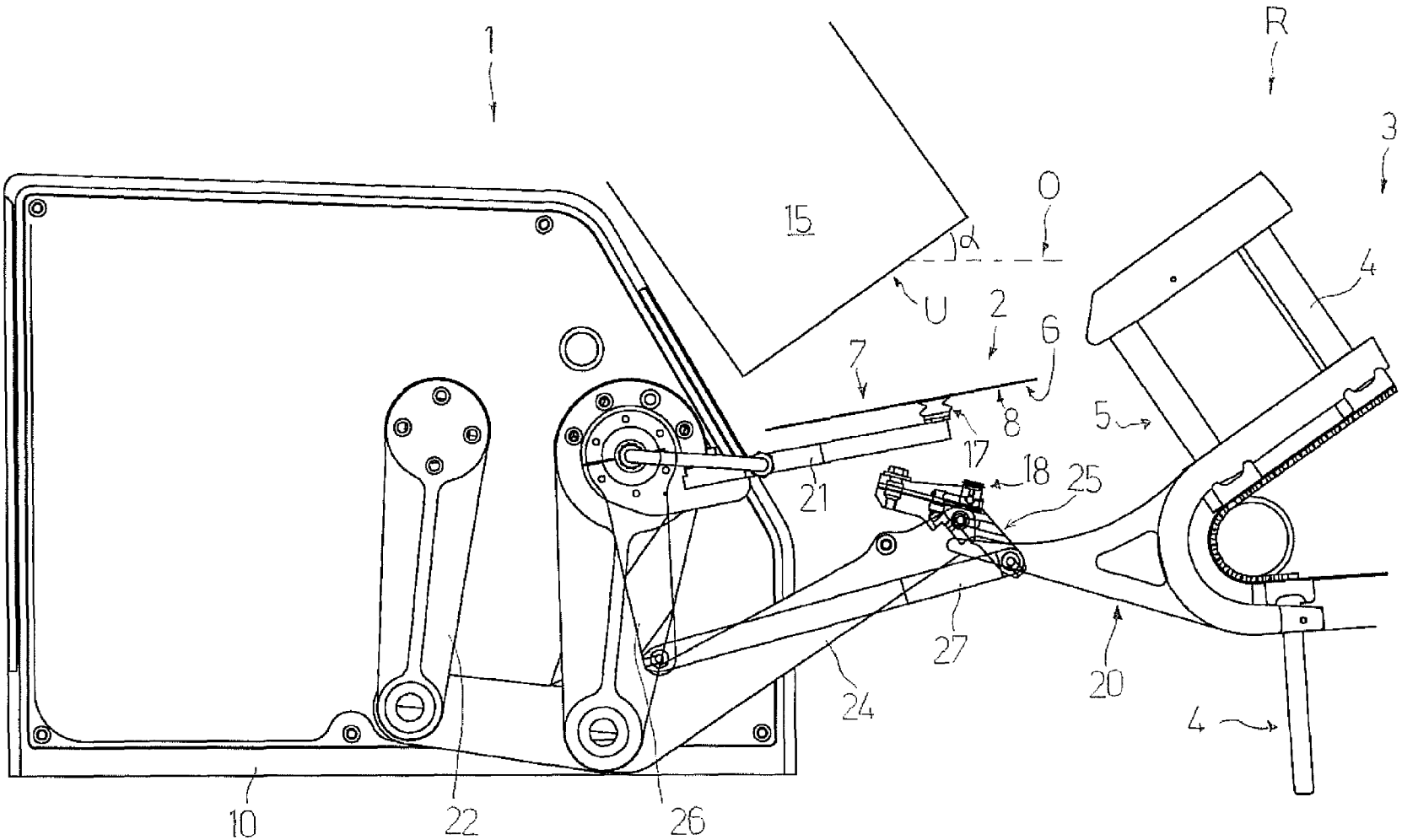
FIGS. 1, 2, 3, 4, 5, 6, 7 are lateral views in which the apparatus of the present invention is illustrated in seven operating steps.

Initially the tubular box (2) in the flattened configuration is arranged in the store (15) and is collectable from the outlet (U) thereof. The first member (21) is at the outlet (U) of the store (15), such that the suckers of the first aspirating means (17) face the first wall (8) of the first sheet (6) of the tubular box (2) in the flattened configuration; the first aspirating means (17) are activated and the first member (21) abuts, via the first aspirating means (17), the first wall (8); thus the tubular box (2) is collected in the flattened configuration and the first member is rotated to bring the tubular box (2) in the flattened configuration towards the folding position (P) (FIG. 1).

Figure 2:
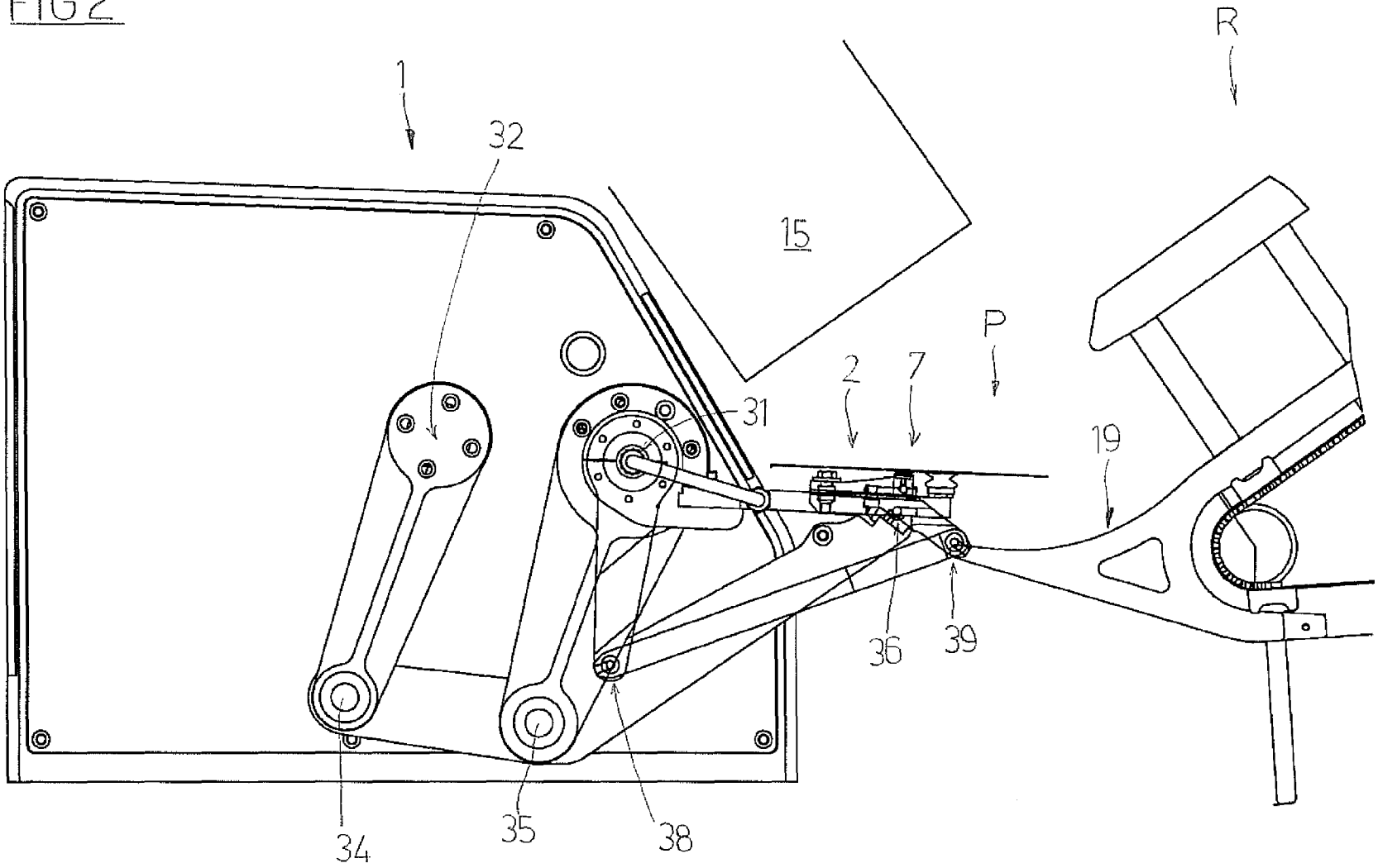

FIG. 2 illustrates the tubular box (2) in a flattened configuration in the folding position (P): the fifth member (25) is arranged in such a way that the suckers of the second aspirating means (18) can intercept the second wall (9) of the first sheet (6) of the tubular box (2) and the second aspirating means (18) are active to retain the second wall (9) of the first sheet (6) of the tubular box (2); the first aspirating means (17) are also active in retaining the first wall (8) of the first sheet (6).

Then the fifth member (25) and the first member (21) are activated in phase relation with one another such as to realize the folding of the second wall (9) of the first sheet (6) of the tubular box (2) with respect to the first wall (8) of the first sheet (6), see FIGS. 3, 4; the first aspirating means (17) and the second aspirating means (18) are active. With the aim of realizing the above folding, both the first wall (8) and the second wall (9) are moved; in particular, the second wall (9) is rotated with respect to the first wall (8) about a hinge axis that coincides with the first fold line (11); this is particularly advantageous because undesired dragging of the suckers of the first aspirating means (17) and the suckers of the second aspirating means (18), respectively on the first wall (8) and the second wall (9), is avoided, and thus any possible damage to the tubular box (2) is prevented.

Thereafter, in phase relation with the folding of the second wall (9) with respect to the first wall (8), the following occurs: the deactivating of the first aspirating means; a further rotation of the first member (21) for disengaging the suckers of the first aspirating means from the first wall (8); and the moving of the fifth member (25) (the second aspirating means are active) such as to transfer the tubular box (2) restingly onto the abutting surface (19) of the abutting member (20) (see FIG. 5).

The tubular box (2) is then transferred onto the abutting member (20) and moved along the abutting surface (19) thereof such as to reach the opened-out position (FIGS. 6, 7). A pair of elongate drawing elements (4) then abuts the second wall (9) of the tubular box (2) and moves it in a known way towards a filling station (not illustrated) of the tubular box (2); in suitable phase relation the second aspirating means (18) are deactivated.

Once the tubular box (2) has been transferred onto the abutting member (20) and is external of the range of action of the first member (21), the first member (21) can be activated such as to return towards the outlet (U) of the store (15) and collect a further tubular box (2) in a flattened configuration; in fact, the first member (21) on the one hand, and the first member (25), the seventh member (27) and the fourth member (24), on the other hand, do not interfere with one another; for example, the first member (21) forms a fork element, see FIG. 7A.

Thus an operating cycle of the apparatus (1) terminates.

Thus a collecting system for collecting a tubular box (2) in a flattened configuration from a store (15) is defined, for opening out the tubular box (2) and for transferring the tubular box (2) towards a receiving station (R) of the tubular box (2), which system comprises the apparatus (1) as described above, the store (15) and the receiving station (R).

The above is understood to have been described by way of non-limiting example, and any constructional variants are considered to fall within the protective scope of the technical solution as claimed in the following.

The invention claimed is:

1. An apparatus (1) for collecting a tubular box (2) in a flattened configuration, opening-out the tubular box (2) and for transferring the tubular box (2) towards a receiving station (R) of the tubular box (2), comprising:

a store (15) for storing the tubular box (2) in a flattened configuration, the store (15) having an outlet (U) from which the tubular box (2) can be collected, the tubular box (2) comprising a first sheet (6) and a second sheet (7) which are in contact with one another or in close proximity to one another, the first sheet (6) being connected to the second sheet (7) at two common and opposite ends, the first sheet (6) being provided with a first wall and a second wall (9) which are separated from one another by a first fold line (11), the tubular box (2) in the flattened configuration being stored in the store (15) at a first angle (a) of inclination with respect to a horizontal plane (0) so that the first sheet (6) of the tubular box (2) is facing towards an outer side of the outlet such that the first wall (8) of the first sheet (6) is at a greater height or elevation than the second wall (9) with respect to the first fold line (11), the apparatus (1) further comprising:

a frame (10) positioned in a vicinity of a box receiving station (R) and the outlet (U) of the store (15);

a first member (21) which is hinged to the frame (10) at a first hinge axis (31) in a position below the outlet of the store (15), the first member bearing first aspirating means (17);

a second member (22) hinged to the frame (10) at a second hinge axis (32);

a third member (23) hinged to the frame (10) at a third hinge axis which coincides with the first hinge axis (31);

a fourth member (24) hinged to the second member (22) at a fourth hinge axis (34) and to the third member (23) at a fifth hinge axis (35);

the second member (22), the third member (23), the fourth member (24) and the frame (10) forming a four-bar linkage;

a fifth member (25) having a first end, a second end, and a central portion and being hinged via the central portion to the fourth member (24) at a sixth hinge axis (36), the fifth member bearing second aspirating means (18) at the central portion thereof;

a sixth member (26), which is hinged to the frame (10) at a seventh hinge axis which coincides with the first hinge axis (31) and the third hinge axis; and a seventh member (27), which is hinged to the sixth member (26) at an eighth hinge axis (38) and which is hinged to the first end of the fifth member (25) at a ninth hinge axis (39), the sixth member (26) and the seventh member (27) being configured to move the fifth member (25), an abutting member (20) for encountering the first wall (8) of the first sheet (6) of the tubular box (2), which abutting member (20) is arranged between the first member (21) and the receiving station (R) and is arranged inferiorly of or below the tubular box (2) when the tubular box (2) is in the folding position (P);

the apparatus being configured such that:

the first member (21) is rotatable to bring the first aspirating means (17) to intercept and retain the first wall (8) of the first sheet (6) at the outlet (U) of the store (15) and is further rotatable to collect and take out the tubular box (2) in flattened configuration from the outlet (U) of the store (15) and bring the tubular box (2) retained by the first aspirating means (17) downward into an unfolding position (P) which is below the outlet (U) of the store (15);

when the tubular box (2) is brought into the unfolding position (P) and retained by the first aspirating means (17) in this unfolding position (P), the fifth member (25) is rotatable to bring the second aspirating means (18) to intercept and retain the second wall (9) of the first sheet (6) and then the first member (21) and fifth member (25) are further rotatable to move the first wall (8) and the second wall (9) to rotate the second wall (9) with respect to the first wall (8) about a hinge axis that coincides with the first fold line (11); and the first member (21) is further rotatable for disengaging the first aspirating means (17) from the first wall (8) and the fifth member (25) is further rotatable so that the tubular box (2) can be moved by the second aspirating means (18) from the unfolding position (P) up to coming to rest on the abutting member (20) with a consequent complete opening-out of the tubular box (2).

2. The apparatus of claim 1, wherein the first hinge axis (31), the second hinge axis (32), the third hinge axis, the fourth hinge axis (34), the fifth hinge axis (35) and the sixth hinge axis (36) are parallel to one another and horizontal.

3. The apparatus of claim 1, wherein the four-bar linkage is a parallelogram linkage.

* * * * *